US006343445B1

(12) United States Patent
Ryan

(10) Patent No.: US 6,343,445 B1
(45) Date of Patent: Feb. 5, 2002

(54) TOWER STRUCTURE

(75) Inventor: Ray R. Ryan, Newburgh, IN (US)

(73) Assignee: General Signal Corporation, Muskegon, MI (US)

( * ) Notice: Subject to any disclaimer, the term of this patent is extended or adjusted under 35 U.S.C. 154(b) by 0 days.

(21) Appl. No.: 09/519,684

(22) Filed: Mar. 7, 2000

(51) Int. Cl.[7] ..... E04H 12/20

(52) U.S. Cl. ..... 52/148; 52/152; 52/295; 52/651.08

(58) Field of Search ..... 52/40, 123.1, 146, 52/148, 152, 651.07, 651.08, 651.09, 651.01, 651.02, 651.03, 745.17, 745.18, 741.14, 741.15, 745.04, 295, 296

(56) References Cited

U.S. PATENT DOCUMENTS

| | | | | |
|---|---|---|---|---|
| 297,331 A | | 4/1884 | Adams | |
| 793,651 A | | 7/1905 | Fessenden | |
| 1,235,332 A | | 7/1917 | Lachman | |
| 2,116,368 A | | 5/1938 | Staubitz | |
| 2,204,026 A | | 6/1940 | Peters | |
| 2,369,533 A | | 2/1945 | Cohen | |
| 2,583,287 A | | 1/1952 | Andrews | |
| 2,761,531 A | * | 9/1956 | Anderson | 52/651.08 |
| 2,844,231 A | | 7/1958 | Weeks | |
| 2,857,994 A | * | 10/1958 | Sheard | 52/651.07 |
| 3,062,336 A | | 11/1962 | Baxter | |
| 3,119,471 A | | 1/1964 | Turner | |
| 3,368,319 A | | 2/1968 | Werner et al. | |
| 3,371,458 A | | 3/1968 | Sturgill | |
| 3,550,146 A | | 12/1970 | Eberle | |
| 3,665,479 A | | 5/1972 | Silliman | |
| 3,670,471 A | * | 6/1972 | Smith | 52/657.01 |
| 3,977,139 A | | 8/1976 | Bryant | |
| 4,134,707 A | * | 1/1979 | Ewers | 290/55 |
| 4,216,636 A | | 8/1980 | Cordell | |
| 4,357,786 A | | 11/1982 | Finzi | |
| 4,694,630 A | | 9/1987 | McGinnis | |
| 4,899,500 A | | 2/1990 | Miller et al. | |
| 4,912,893 A | | 4/1990 | Miller et al. | |
| 5,044,828 A | | 9/1991 | Berner, Jr. et al. | |
| 5,072,555 A | | 12/1991 | Geiger | |
| 5,097,647 A | | 3/1992 | Sopik et al. | |
| 5,333,436 A | | 8/1994 | Noble | |
| 5,577,362 A | | 11/1996 | Yamashita et al. | |
| 5,649,402 A | | 7/1997 | Moore | |
| 5,787,673 A | | 8/1998 | Noble | |

FOREIGN PATENT DOCUMENTS

FR 443361 9/1912

OTHER PUBLICATIONS

Microwave Towers by Tower Construction Co., 2700 Hawkeye Drive, Sioux City, Iowa USA—Form No. MWT–4, 1959.

* cited by examiner

*Primary Examiner*—Michael Safavi
(74) *Attorney, Agent, or Firm*—Baker & Hostetler, LLP

(57) ABSTRACT

A tower support structure for supporting communications equipment or other types of equipment above the ground is provided. The structure includes a foundation, a tower having a number of tower sections is supported by the foundation. The tower includes main bracing systems and sub-bracing systems extending between the tower columns. A cable support structure is anchored to the ground and is also connected to the tower.

35 Claims, 8 Drawing Sheets

TOWER STRUCTURE

BACKGROUND OF THE INVENTION

The present invention relates generally to structural systems, and more particularly to a tower structure.

Methods and techniques for the design and construction of towers are faced with many problems. Among the problems that are presented include construction difficulties due to tower height and complex component assemblies, the desire to support large loads, the tower height, the weight of the tower, and the external conditions that act upon the tower, such as wind, earthquakes, and the like. All of these factors, among others, affect the tower design and must be considered in order to design and construct a tower that is constructable yet has the required stability and strength to perform the desired task. As the height of the tower increases, the above-described problems are amplified and the tower design becomes more economically unfeasible due to the size of the tower components, the complexity of the tower design, and the cost of the tower versus the benefit obtained with the increased tower height.

The design and construction of tower structures has been the subject of prior art patents. For example, U.S. Pat. No. 3,368,319 to Werner et al. describes a tower having a triangular truss cross-section with three legs and continuous Warren bracing interconnecting the legs. The legs have a modified channel cross-section to provide a two-to-one ratio of radius of gyration about different axes. A number of anchored guide wires are connected to each of the corner columns at various heights along the tower.

U.S. Pat. No. 5,072,555 describes a super high-rise tower formed from a central rigid core supported by a pretensioned cable network around the core. U.S. Pat. No. 5,097,647 describes the support tower for communication equipment having three generally parallel legs positioned to form a triangular cross-section. Cross bracing is provided to secure the legs one to another intermediate the ends of the legs to provide lateral support for the tower. U.S. Pat. No. 1,235,332 to Lachman describes a pole having a T-bars, Y-bars or channel bars forming the main corner columns of the pole section. These bars are connected by lateral members. U.S. Pat. No. 3,550,146 to Eberle; U.S. Pat. No. 3,062,336 to Baxter; and U.S. Pat. No. 5,649,402 to Moore, each describe other types of tower designs for supporting communication equipment, electrical distribution equipment and the like.

While the prior art patents demonstrate many different attempts to address the problems in tower design and construction, the need for improvement remains. There remains a need for a tower for supporting communications equipment and other types of equipment at distances above the ground that utilizes an efficient and constructable structural support system. The structural support system should also be suited for the design and construction of towers having a height greater than four hundred feet, although the structural system should also have application in shorter tower design and construction. The present invention is directed towards meeting these needs, among others.

SUMMARY OF THE INVENTION

The present invention is directed to a tower structure for supporting communications equipment or other types of equipment above the ground. The structure includes a foundation, a tower supported by the foundation that has a number of tower sections, and a cable support structure connected to the tower and anchored to the ground.

In one form, the present invention includes a structure for supporting an object above the ground. The structure includes a foundation and a tower supported by the foundation. The tower has a number of sides each extending between paired ones of a number of corner columns. Each of the sides including at least one intermediate column between paired corner columns. An anchored cable support system extends between the ground and the tower. The cable support system includes a plurality of cable sets connected to the tower with at least one cable set on each side of the tower. Each of the at least one cable sets have a first cable connected to one of the paired corner columns, a second cable connected to the other of the paired corner columns, and a third cable connected to the at least one intermediate column. In one embodiment, the tower has a triangular cross-section and there are two intermediate columns between paired ones of the corner columns. Each of the at least one cable sets includes a fourth cable connected to the other of the two intermediate columns.

In another form of the present invention, a structure for supporting an object above the ground is provided. The structure includes a foundation and a tower supported by the foundation. The tower has a first corner column, a second corner column, and a third corner column and a first side extending between the third corner column and the first corner column, a second side extending between the first corner column and the second corner column, and a third side extending between the second corner column and the third corner column. Each of the three tower sides includes a first intermediate column and a second intermediate column between the corner columns. A main bracing system on each of the sides extends between the first and second intermediate columns. A first sub-bracing system on each of the sides extends between the first intermediate column and an adjacent one of the corner columns. A second sub-bracing system on each of the sides extends between the second intermediate column and the other of the corner columns. An anchored cable support system is connected to the tower.

In one embodiment, a first internal sub-bracing system extends between the second intermediate column of the first side and the first intermediate column of the second side. A second internal sub-bracing system extends between the second intermediate column of the second side and the first intermediate column of the third side. Also, a third internal sub-bracing system extends between the second intermediate column of the third side and the first intermediate column of the first side.

In yet another form of the present invention, a structure for supporting an object above the ground is provided. The structure includes a foundation and a tower supported by the foundation. The tower includes a number of tower sections each having a first corner column, a second corner column, and a third corner column. A first side extends between the third corner column and the first corner column, a second side extends between the first corner column and the second corner column, and a third side extends between the second corner column and the third corner column. Each of the sections includes a first truss, a second truss, and a third truss having a triangular cross-section defined by the first corner column, a first intermediate column on one side and a second intermediate column on an adjacent side. Each truss includes a first sub-bracing system extending between the first intermediate column and the corner column and a second sub-bracing system extending between the second intermediate column and the corner column.

In one embodiment, there is further provided a first main bracing system extending between and coupled to the first truss and the second truss; a second main bracing system extending between and coupled to the second truss and the third truss; and a third main bracing system extending between and coupled to the first truss and the third truss. In a further embodiment, each truss includes an internal bracing system extending between the intermediate columns.

These and other objects, advantages, forms, aspects, and features the present invention will be apparent from the following description.

DESCRIPTION OF THE PREFERRED EMBODIMENTS

Figure 1:
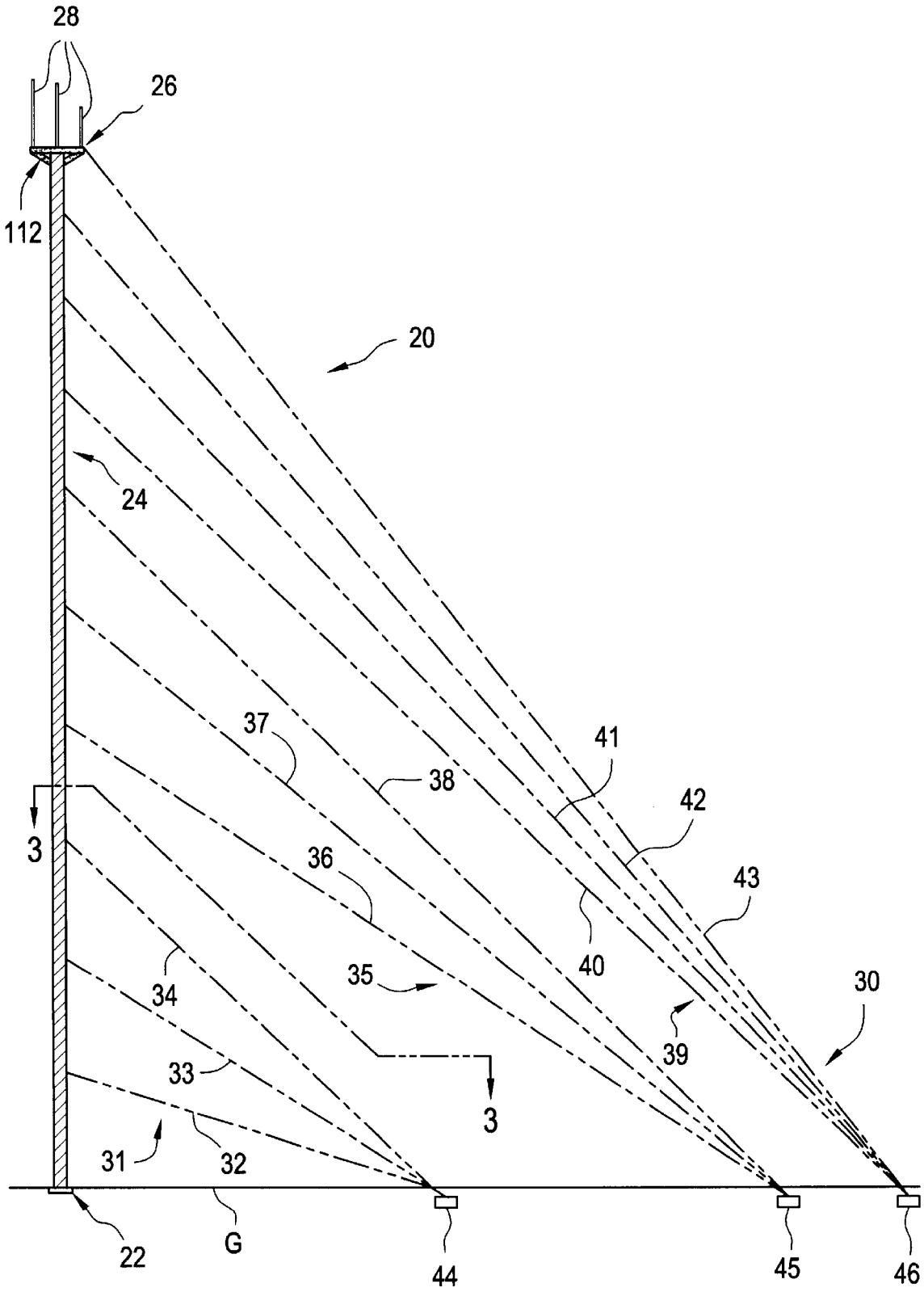
FIG. 1 is a side elevational view of a portion of a tower structure according to the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the illustrated device, and further applications of the principles of the invention as illustrated therein, are contemplated as would normally occur to one skilled in the art to which the invention relates.

In FIG. 1 there is illustrated a tower structure 20 having a cable support system 30 connected to a tower 24. Tower structure 20 is useful as a tall structure for supporting communications and other equipment at distances above ground level G. Tower structure 20 includes a foundation 22 that supports tower 24. Foundation 22 is supported by the earth below ground level G as known in the art below. Preferably foundation 22 is a reinforced concrete mat foundation; however, other foundation structures are also contemplated, including, for example, isolated footings for each column, pile supported foundations, drilled piers, or caissons. Tower 24 extends upwardly above ground level G from foundation 22 to a platform 26 at the top of tower 24. Communications or any other type of equipment, such as receivers, transmitters, relay equipment, etc. could be positioned on platform 26 as would occur to those skilled in the art. In the illustrated embodiment, antennae 28 are positioned on platform 26. Alternatively, tower 24 could be provided without any platform, and the equipment could be mounted directly on tower 24.

Figure 2:
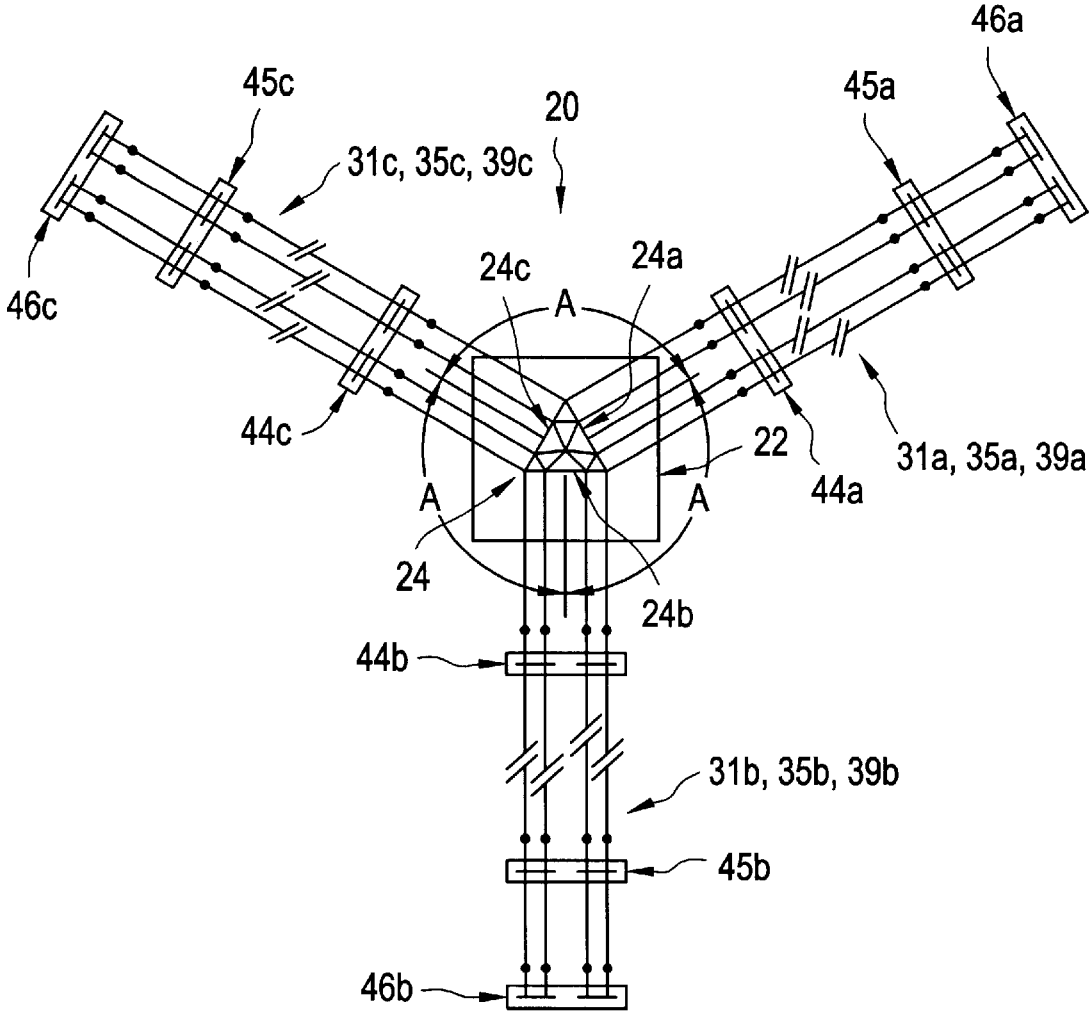
FIG. 2 is a somewhat enlarged top plan view of the tower structure of the present invention with the platform removed.

Tower structure 20 also includes a cable support system 30 that provides lateral stability to tower 24. For the purposes of clarity, only a portion of cable support system 30 is illustrated in FIG. 1, that portion being associated with one of the sides of tower 24. As shown in FIG. 2, cable support system 30 includes cables and anchors that are associated with each of a first side 24*a*, a second side 24*b*, and a third side 24*c* of tower 24. In the discussion that follows, references to features associated with a specific one the tower sides 24*a*, 24*b*, or 24*c* will include the corresponding letter designation a, b, or c after the reference numeral assigned to the feature. If no letter designation accompanies the reference numeral, then the discussion pertains to all the tower sides.

Referring back to FIG. 1, cable support system 30 includes a proximal anchor 44, a middle anchor 45, and a distal anchor 46 secured to the earth below ground surface G. Coupled to anchors 44, 45, and 46 are a lower cable group 31, an intermediate cable group 35, and an upper cable group 39, respectively. Lower cable group 31 includes a first cable set 32, a second cable set 33, and a third cable set 34 connected to tower 24. Similarly, intermediate cable group 35 includes a first cable set 36, a second cable set 37, and a third cable set 38 connected to tower 24. Upper cable group 39 includes a first cable set 40, a second cable set 41, and a third cable set 42 connected to tower 24. In addition, a platform cable set 43 is connected with platform 26 and coupled to distal anchor 46. Although three cable sets are shown coupled to each of the anchors, it is also contemplated that more or fewer cable sets can be coupled to each anchor. As is apparent from FIG. 1, each of the cable sets 32, 33, 34, 36, 37, 38, 40, 41, and 42 are connected to tower 24 at various elevations along the height of tower 24. The determination of the connection elevations for the cable sets and the spacing of anchors 44, 45, and 46 can be determined by one of ordinary skill in the art and varies based on tower height and loading conditions, among other factors. Also, in the illustrated embodiments, anchors 44, 45, and 46 are reinforced concrete anchors. However, the present invention also contemplates other anchoring systems, including pilings, tie-back systems, and the like.

Tower 24 preferably has a triangular cross-section, as shown in FIG. 2, and includes first side 24*a*, second side 24*b*, and third side 24*c*. However, aspects of the present invention may have application with other cross-sectional shapes, such as square or rectangular cross-sections. As illustrated more clearly in FIG. 2, cable support system 30 includes a number of cable groups connected to each of the three sides of tower 24. The cable groups have centerlines extending from tower 24 that are spaced by angle A, which, in the illustrated embodiment, is 120 degrees. In the illustrated embodiment, connected at side 24*a* are a lower cable group 31*a* extending to proximal anchor 44*a*, an intermediate cable group 35*a* extending to intermediate anchor 45*a*, and an upper cable group 39*a* extending to distal anchor 46*a*. Connected at side 24*b* are a lower cable group 31*b* extending to proximal anchor 44*b*, an intermediate cable group 35*b* extending to intermediate anchor 45*b*, and an upper cable group 39*b* extending to distal anchor 46*b*. Connected at side 24*c* are a lower cable group 31*c* extending to proximal anchor 44*c*, an intermediate cable group 35*c* extending to intermediate anchor 45*c*, and an upper cable group 39*c* extending to distal anchor 46*c*.

Figure 3:
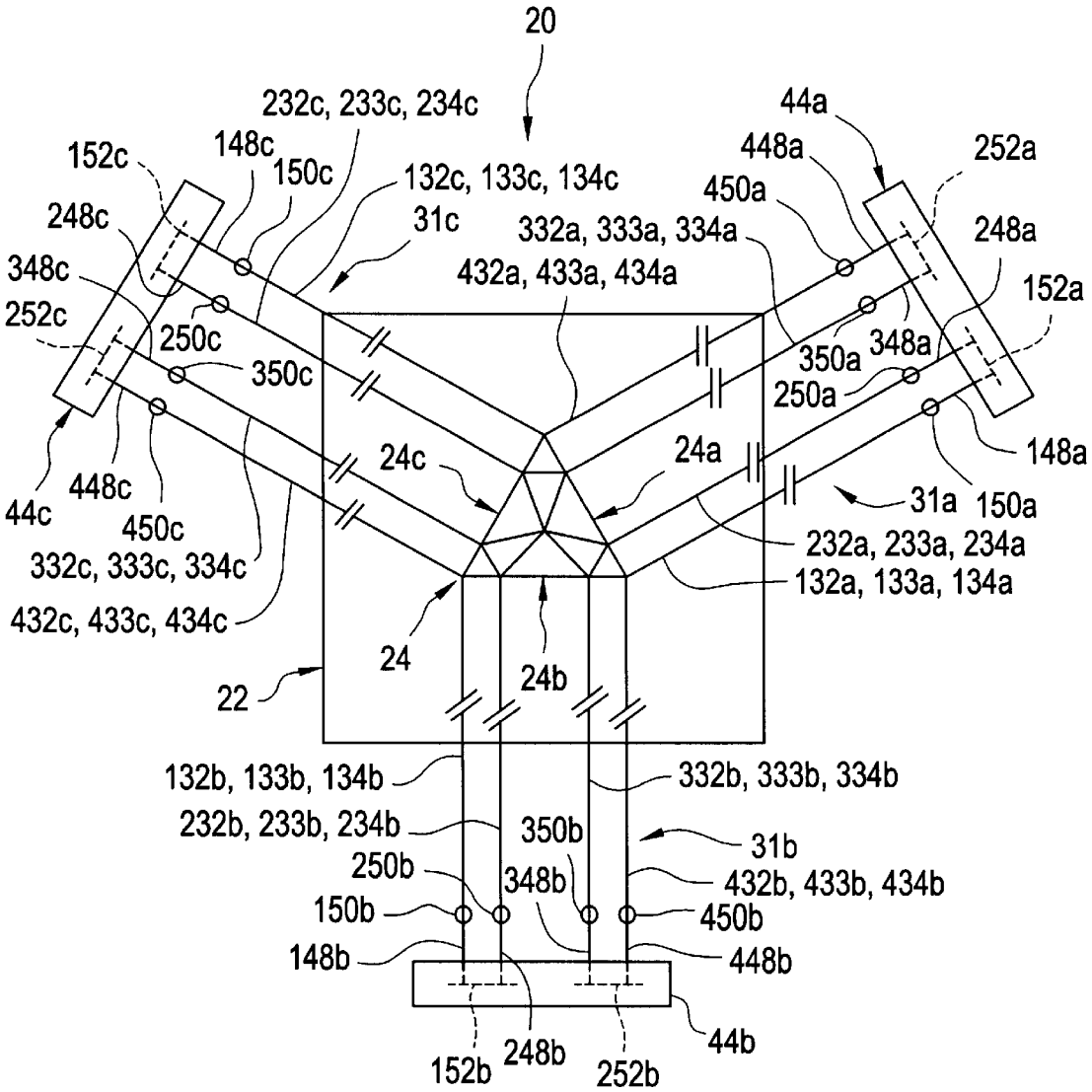
FIG. 3 is an enlarged cross-sectional view taken through line 3—3 of FIG. 1.

Referring now to FIG. 3, the cable sets will be described in greater detail with reference to the cable sets comprising lower cable group 31, it being understood that the cable sets comprising groups 35 and 39 are similarly arranged but connected at higher elevations to tower 24 and also coupled to the corresponding anchors 45 and 46. First cable group 31*a* includes lower cable set 32*a* having a first cable 132*a*, a second cable 232*a*, a third cable 332*a*, and a fourth cable 432*a*. Similarly, second cable set 33*a*includes a first cable 133*a*, a second cable 233*a*, a third cable 333*a* and a fourth cable 433*a*. Third cable set 34*a* includes a first cable 134*a*, a second cable 234*a*, a third cable 334*a*, and a fourth cable 434*a*. It should be understood that the three first cables 132*a*, 133*a*, and 134*a* of cable group 31*a* are indicated by a single line in FIG. 3 because each of the first cables are positioned directly above one another. The second cables of the first cable group, the third cables of the first cable group, and the fourth cables of the first cable group are each similarly situated directly above one another. Further, as explained in more detail below, the first and fourth cables of each cable set are connected to corner columns of tower 24 and the second and third cables of each cable set are connected to intermediate columns of tower 24.

Each of the first cables 132*a*, 133*a*, and 134*a* from cable group 31*a* are connected to a first turnbuckle 150*a*. Each of the second cables 232*a*, 233*a*, and 234*a* from cable group 31*a* are connected to a second turnbuckle 250*a*. Each of the third cables 332*a*, 333*a*, and 334*a* from cable group 31*a* are connected to a third turnbuckle 150*a*. Each of the fourth cables 432*a*, 433*a*, and 434*a* from cable group 31*a* are connected to a fourth turnbuckle 450*a*. The turnbuckles 150*a* and 250*a* are secured to anchor 44*a* by a corresponding anchor extension 148*a* and 248*a*, respectively, extending into anchor 44*a*. A connector 152*a* extends between and is connected to anchor extensions 148*a* and 248*a* to resist pull-out of from anchor 44*a*. The turnbuckles 350*a* and 450*a* are secured to anchor 44*a* by a corresponding anchor extension 348*a* and 448*a*, respectively, extending into anchor 44*a*. A connector 252*a* extends between and is connected to anchor extensions 348*a* and 448*a* to resist pull-out from anchor 44*a*.

It will be apparent upon inspection of FIG. 3 that cable group 31*b* on second side 24*b* and cable group 31*c* on third side 24*c* are arranged similarly as discussed above with respect to cable group 31*a* on first side 24*a*. The cables of cable support system 30 are preferably made from structural bridge strand guy wire. Preferably, each of the cables is pre-tensioned with an initial load in the range of 20 to 40 percent of the cable design load, depending on the temperature during construction and other factors. Further, the determination of the appropriate size turnbuckles, ear plates for connecting the cables to the turnbuckles, anchor extensions, anchors, connectors and the like are believed to be within the abilities of one of ordinary skill in the art to which the present invention relates.

Figure 4:
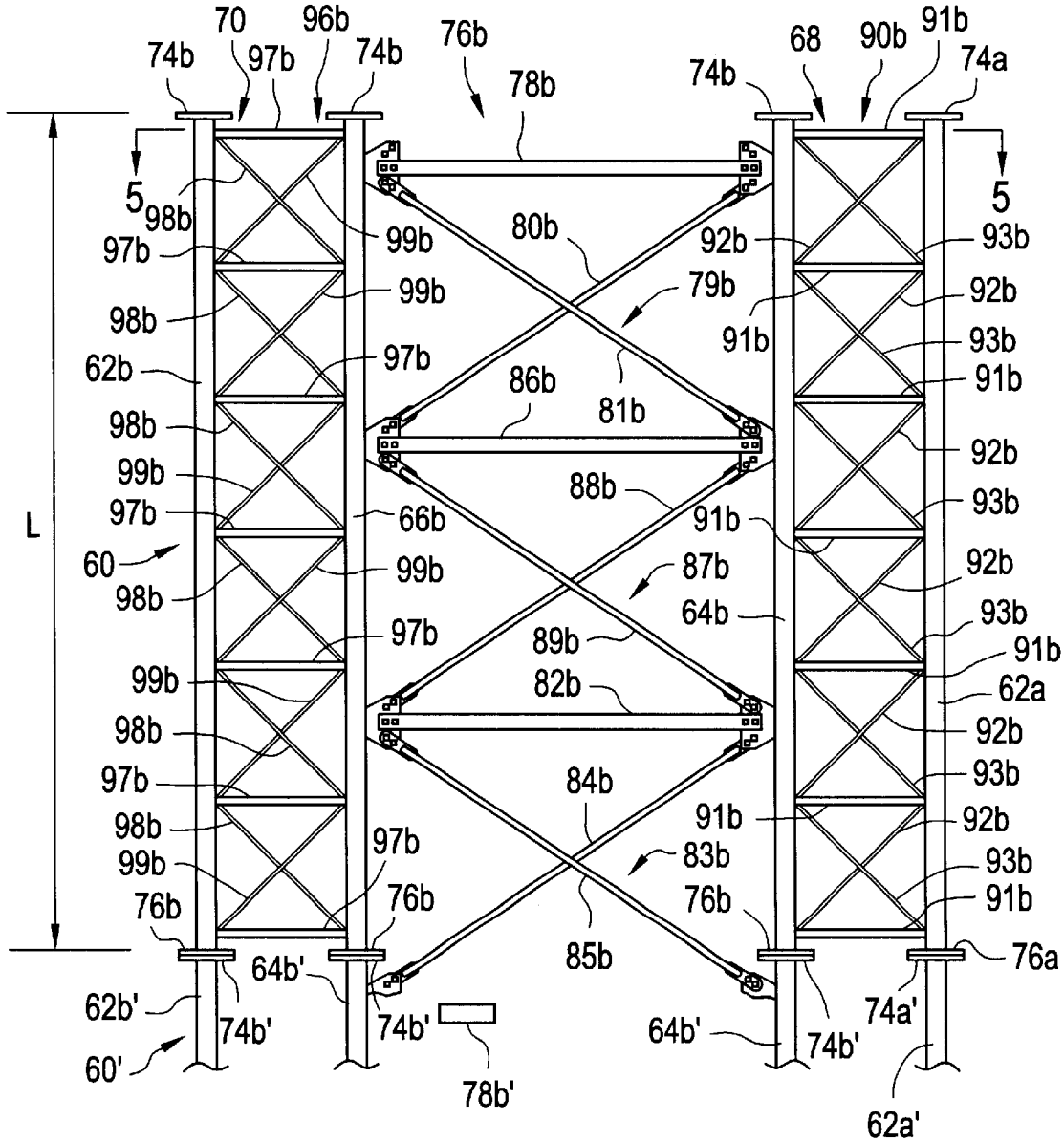
FIG. 4 is an enlarged side elevational view of a section of the tower structure of FIG. 1.
Figure 5:
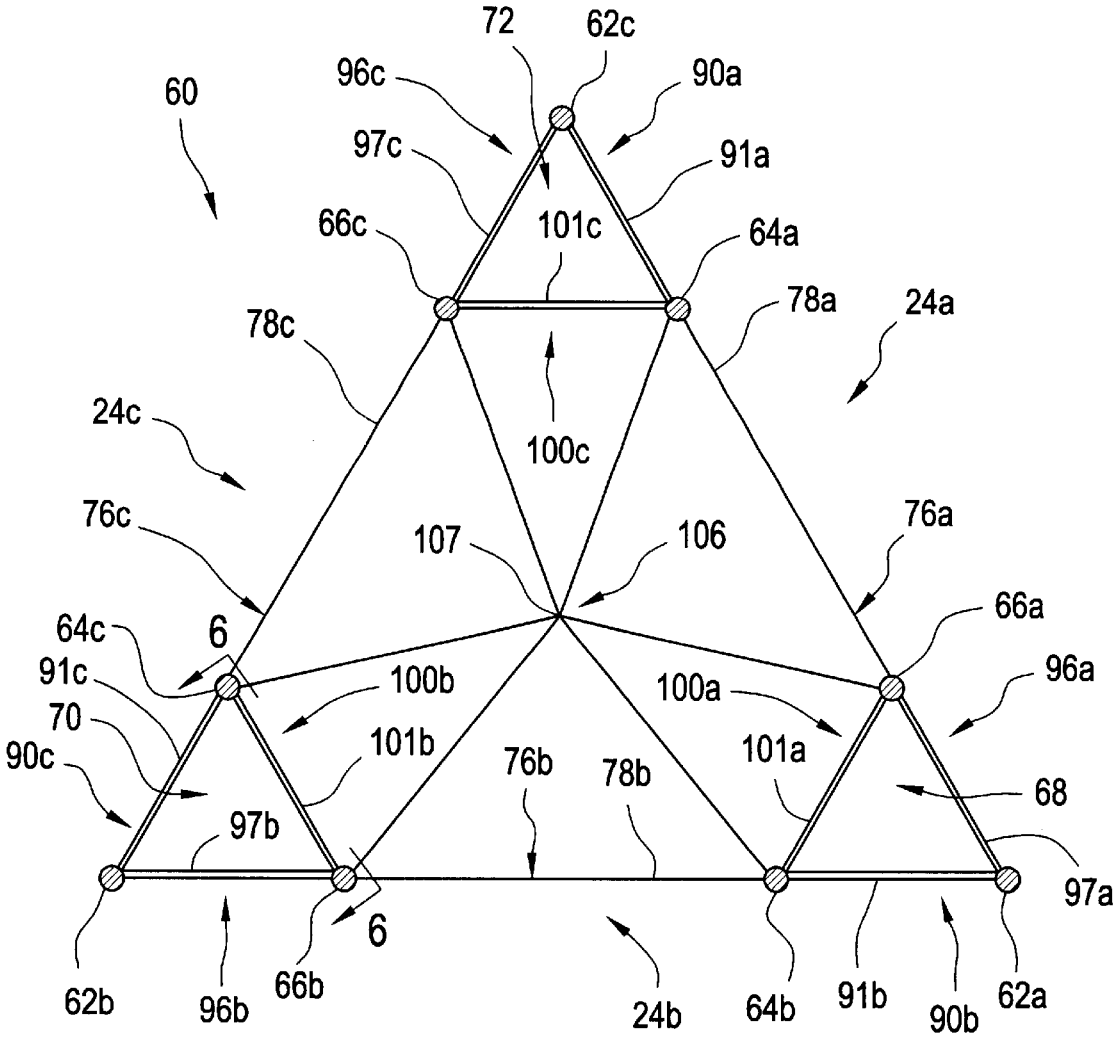
FIG. 5 is a cross-sectional view taken through line 5—5 of FIG. 4.

Referring now to FIGS. 4 and 5, a section 60 of tower 24 is illustrated in greater detail. It should be understood that for constructability tower 24 comprises a number of sections 60 positioned one on top another and connected together via standard fastening techniques. Section 60 includes a first corner column 62*a*, a second corner column 62*b*, and a third corner column 62*c*. Positioned between paired ones of the corner columns 62 are first intermediate column 64 and second intermediate column 66. In FIG. 5, the intermediate columns along side 24*b* are first intermediate column 64*b* and second intermediate column 66*b* positioned between and adjacent to paired corner columns 62*a*and 62*b*, respectively. The intermediate columns of side 24*a* are first intermediate column 64*a* and second intermediate column 66*a* positioned between and adjacent to paired corner columns 62*c* and 62*a*, respectively. On side 24*c* there is first intermediate column 64*c* and second intermediate column 66*c* positioned between and adjacent to paired corner columns 62*b* and 62*c*, respectively.

Tower 24 has an overall cross-section that is triangular in shape. Included in this overall triangular-shaped cross-section are a first truss 68, a second truss 70, and a third truss 72, each truss 68, 70, and 72 also having a triangular cross-section and having a length L substantially corresponding to the height of tower section 60. Corner column 62*a*, second intermediate column 66*a*, and first intermediate column 64*b* form the vertices of first triangular truss 68; corner column 62*b*, second intermediate column 66*b*, and first intermediate column 64*c* form the vertices of second triangular truss 70; and corner column 62*c*, first intermediate column 64*a*, and second intermediate column 66*c* form the vertices of third triangular truss 72. As shown in FIG. 3, the cables are connected to corner columns 62 and to intermediate columns 64 and 66. This arrangement improves lateral and torsional stability of tower 24 and allows an increased tower height.

To further resist twisting of tower 24, an internal tie structure 106 includes a number of wire members extending from a central tie point 107 to each of the intermediate columns 64, 66 of tower section 60. It is contemplated that tie structure 106 only be placed at the top of each of the tower section 60; however, other tie structures may also be provided along the height of tower section 60 as needed.

Extending between and connected to first truss 68 and third truss 72 is main bracing 76*a*; extending between and connected to first truss 68 and second truss 70 is main bracing 76*b*; and extending between and connected to second truss 70 and third truss 72 is main bracing 76*c*. In the illustrated embodiment, main bracing 76 is coupled to the first intermediate column 64 and the second intermediate column 66 that form a part of the connected trusses.

Referring now specifically to FIG. 4, main bracing 76*b* will be described in detail, it being understood that main bracing 76*a* and 76*c* are similarly arranged. Main bracing 76*b* includes upper horizontal member 78*b* extending horizontally between first intermediate column 64*b* and second intermediate column 66*b*. Lower horizontal member 82*b* and intermediate horizontal member 86*b* similarly extend between intermediate columns 64*b* and 66*b*. Horizontal members 78*b*, 86*b* and 82*b* are spaced apart a distance of about one-fourth length L. Lateral bracing 79*b* extends between upper member 78*b* and intermediate member 86*b*. Lateral bracing 79*b* includes a first diagonal member 80*b* and second diagonal member 81*b* forming an X-shape for lateral bracing 79*b*. Extending between intermediate horizontal member 86*b* and lower horizontal member 82*b* is lateral bracing 87*b*, which includes a first diagonal member 88*b* and second diagonal member 89*b* forming an X-shape. Extending from lower horizontal member 82*b* to the upper horizontal member 78*b*' of the next adjacent tower section 60' is lateral bracing 83*b*, providing continuous bracing between adjacent tower sections 60, 60' . Lateral bracing 83*b* includes first diagonal member 84*b* and second diagonal member 85*b* forming an X-shape. In the illustrated embodiment, the horizontal members and the diagonal members are connected to the intermediate columns via bolted connections to gusset plates that are welded to the intermediate columns. The present invention also contemplates other techniques for connecting main bracing 76 to the trusses, these techniques including welding, rivets, bolts, or a combination thereof.

Figure 6:
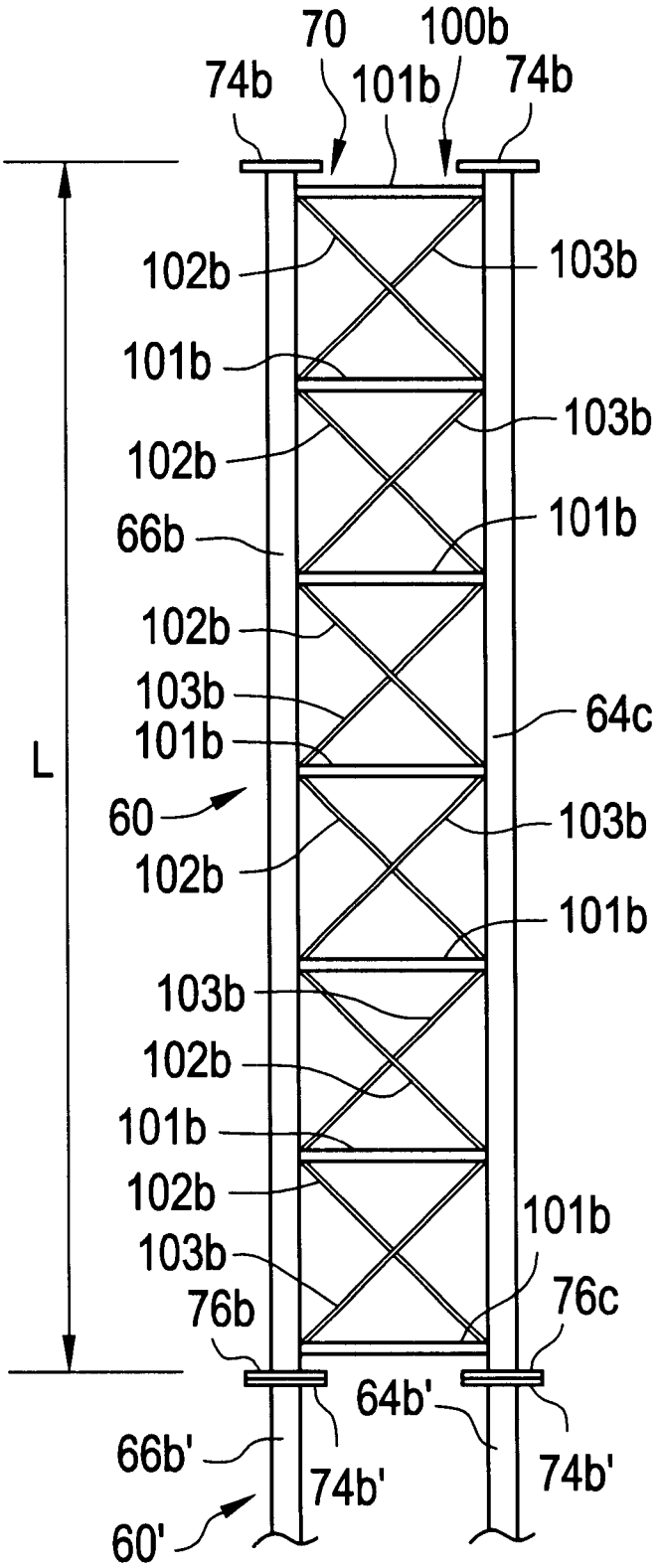
FIG. 6 is a cross-sectional view taken through line 6—6 of FIG. 5.

Each of the trusses 68, 70, and 72 includes sub-bracing systems extending between the columns that form the vertices of the triangular truss. A first sub-bracing system 90 extends between and is connected to corner column 62 and first intermediate column 64 of each truss 68, 70, and 72. A second sub-bracing system 96 extends between and is connected to corner column 62 and second intermediate column 66 of each truss 68, 70, and 72. Tower side 24*a* includes first sub-bracing system 90*a* and second sub-bracing system 90*b*. Tower side 24*b* includes first sub-bracing system 90*b* and second sub-bracing system 90*b*. Tower side 24*c* includes first sub-bracing system 90*c* and second sub-bracing system 90*c*. As shown in FIG. 6, an internal or third sub-bracing system 100 extends between and is connected to first intermediate column 64 and second intermediate column 66. Referring back to FIG. 4, first truss 68 includes third sub-bracing system 100*a*, second truss 70 includes third sub-bracing system 100*b*, and third truss 72 includes third sub-bracing system 100*c*.

Sub-bracing systems 90, 96 and 100 will be described in further detail with reference to sub-bracing system 90*b* in FIG. 4. First sub-bracing system 90*b* includes a number of cross members 91*b* extending horizontally between corner column 62*a* and first intermediate column 64*b*. Sub-bracing system 90*b* also includes first diagonal member 92*b* and second diagonal member 93*b* extending between corner column 62*a* and first intermediate column 64*b* and also between adjacent ones of cross members 91*b*. First and second diagonal member 92*b* and 93*b* form an X-shape in sub-bracing system 90*b*. In the illustrated embodiment, there are seven cross members 91*b* evenly spaced at a distance of one-sixth of length L along tower section 60 with X-shaped diagonal members extending between paired cross members. It is preferred that the components of the sub-bracing system 90*b* are welded to the adjacent components, however, it being understood that bolted or riveted connections may also be used.

Second sub-bracing system 96*b* includes cross members 97*b*, first diagonal members 98*b* and second diagonal members 99*b* arranged between columns 62*b* and 66*b* in a manner substantially the same as described above with respect to first sub-bracing system 90*b*. As shown in FIG. 6, third sub-bracing system 100*b* includes cross members 101*b*, first diagonal members 102*b* and second diagonal members 103*b* arranged between columns 64*c* and 66*b* in a manner substantially the same as described above with respect to first sub-bracing system 90*b*. Sub-bracing systems 90*a*, 90*c*, 96*a*, 96*c*, 100*a* and 100*b* are likewise arranged substantially the same as sub-bracing 90*b*

Adjacent tower section 60' is positioned below tower section 60, it being understood that a plurality of tower sections 60 are provided and positioned one upon another in order to reach the required or desired height of tower 24. Provided at the top of each column 62, 64 and 66 is an upper base plate 74. Provided at the bottom of each column 62, 64, 66 is a lower base plate 76. When adjacent tower sections are positioned one on top the other, the lower base plates 76 of the upper tower section are supported by the upper base plates 74' of the lower tower section 60' . The tower sections 60 and 60' are coupled together via bolts, rivets or a welded connection.

The components of tower 24 are made from structural steel and use standard structural shapes. In the illustrated embodiment, columns 62, 64 and 66 are made from solid round steel stock. Cross members 91, 97, 101 and diagonal members 92, 93, 98, 99, 102 and 103 are also made from solid round steel stock. Main lateral bracing 76 has, in the illustrated embodiment, double angle horizontal members 78, 82 and 86 and round stock for the diagonal members 80, 81, 84, 85, 88, and 89. However, it should be understood that other forms of the present contemplate the use of other structural shapes for these components as would occur to those of ordinary skill in the art. It is also believed that the present invention has application with many different structural materials, including aluminum, galvanized steel, and the like. In addition, portions of tower 24 and cable support system 30 can be made from materials having differing properties. For example, in one specific embodiment, the columns are made from 50,000 pounds per square inch yield strength steel and the main bracing and sub-bracing components are made from 36,000 pounds per square inch yield strength steel.

In order to construct tower 24 according to one specific embodiment of the present invention, each of the trusses 68, 70, and 72 are fabricated prior to erection. In this specific embodiment the sub-bracing systems 90, 96 and 100 are welded to the respective columns 62, 64 and 66 to form the truss sections 68, 70, and 72. The truss sections 68, 70, and 72 are then positioned on an already erected tower section 60' via a crane, helicopter or the like and secured to tower section 60'. Main bracing 76 is then assembled and bolted or riveted to the erected truss sections, and internal tie structure 106 is secured to the intermediate columns 64, 66. Ladders and, if necessary, cables are secured to the columns to complete assembly of the tower section 60. The present invention thus allows tower structure 20 to be efficiently erected in the field since the trusses can be pre-fabricated off-site in a controlled environment and shipped to the site for final assembly. The present invention also provides a tower structure 20 that is efficient in materials yet provides a tall tower. In one specific embodiment, it is believed that an overall tower structure height, including equipment, of about 1750 feet can be achieved.

Figure 7:
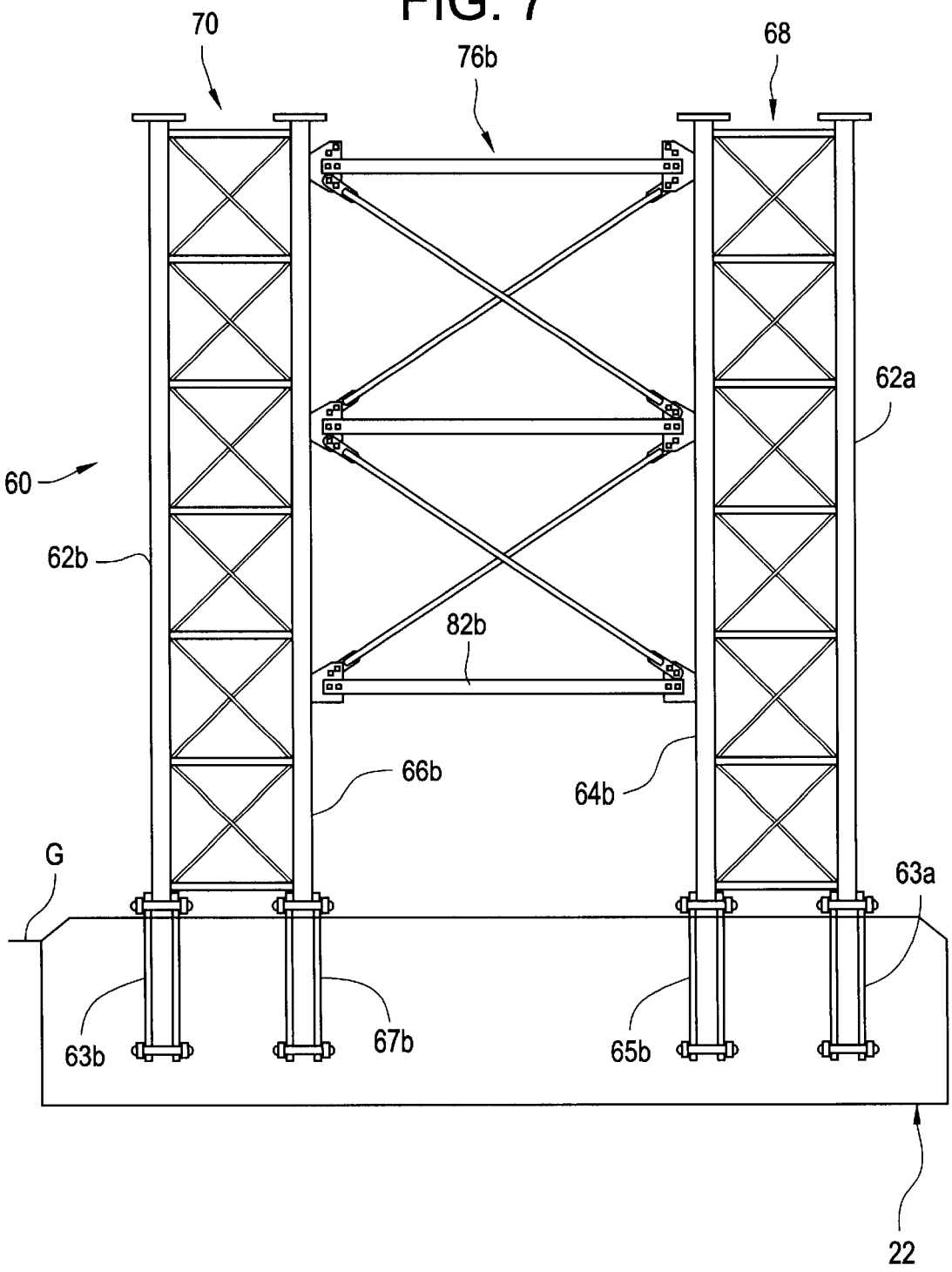
FIG. 7 is a somewhat enlarged side elevational view of the bottom-most section of the tower structure of FIG. 1.

Referring now to FIG. 7, there is illustrated the tower section 60 positioned directly on foundation 22. This bottom-most tower section 60 does not have diagonal members below lower horizontal member 82*b* since there is no lower tower section 60' in which to connect the diagonal bracing. Also illustrated are corner column anchors 63 positioned in and extending from foundation 22 for connection with a base plate on corner columns 62. First intermediate column anchors 65 are positioned in and extend from foundation 22 for connection with a base plate on first intermediate columns 64. Second intermediate column anchors 67 are positioned in and extend from foundation 22 for connection with a base plate on second intermediate columns 66. Preferably, anchors 63, 65 and 67 are anchor bolts.

Figure 8:
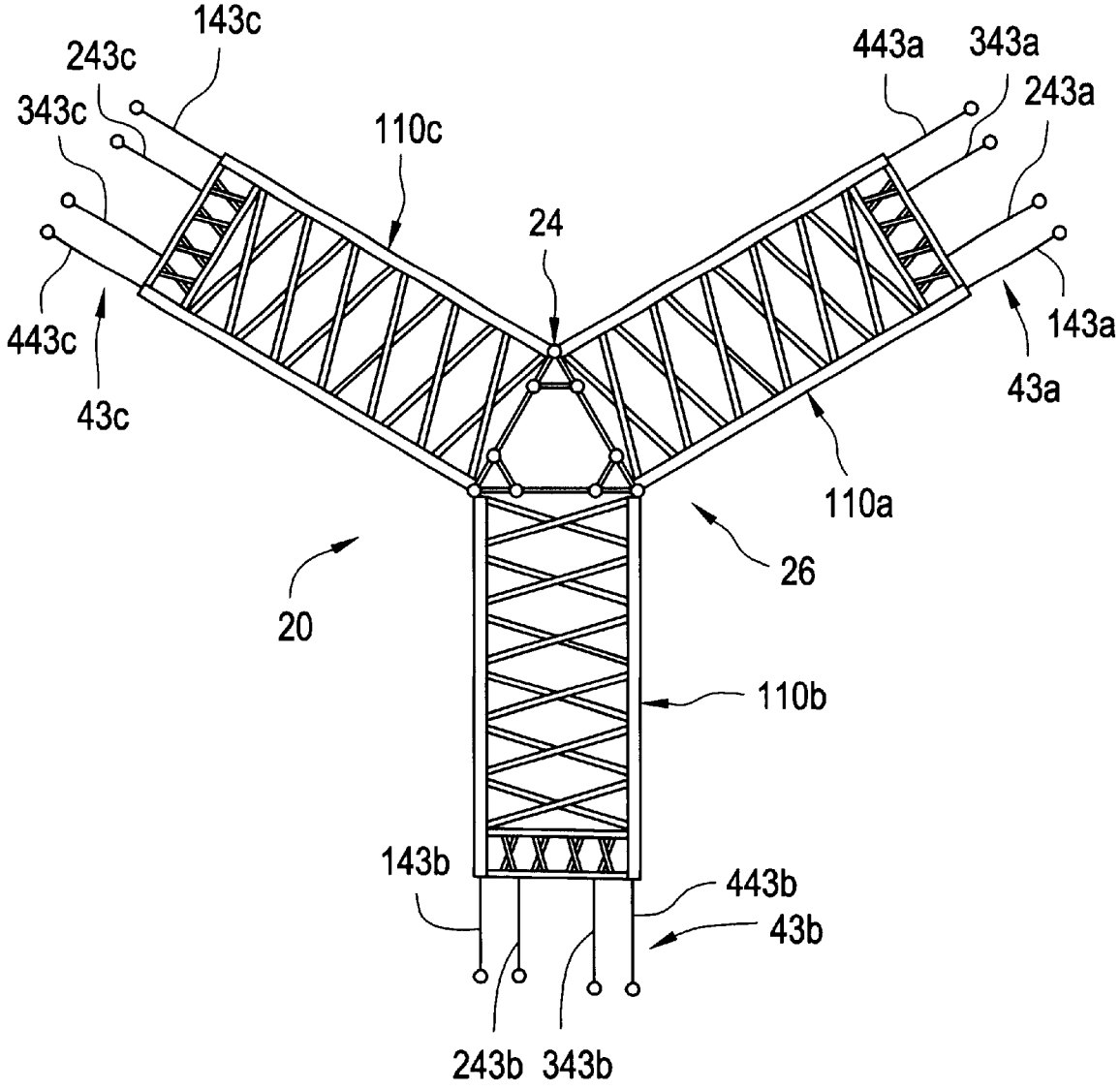
FIG. 8 is an enlarged top plan view of the platform of the tower structure of FIG. 1.

Referring now to FIG. 8, the top plan view of platform 26 is provided. Platform 26 includes first platform section 110*a*, second platform section 110*b*, and third platform section 110*c*. As shown in FIG. 1, these platform sections extend outwardly from a respective one of the tower sides 24*a*, 24*b* and 24*c*. Knee brace sections 112 support respective ones of the cantilevered platform sections 110. Platform cable structure 43 includes first cable set 43*a* having first cable 143*a*, second cable 243*a*, third cable 343*a*, and fourth cable 443*a* each connected to platform section 110*a* and extending to and secured to distal anchor 46*a*; a second cable set 43*b* having first cable 143*b*, second cable 243*b*, third cable 343*b*, and fourth cable 443*b* each connected to platform section 110*b* and extending to and secured to distal anchor 46*b*; and a third first cable set 43*c* having first cable 143*c*, second cable 243*c*, third cable 343*c*, and fourth cable 443*c* each connected to platform section 110*c* and extending to and secured to distal anchor 46*c*. The platform cable sets 43*a*43*b*, and 43*c* provide stability to platform 26 and resist twisting and lateral movement of platform 26 at the top of tower 24.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A structure for supporting an object above the ground, comprising:

a foundation;

a tower extending above the ground supported by said foundation, said tower having a number of sides, each side extending between paired ones of a number of corner columns, each of said sides including at least one intermediate column between said paired corner columns; and a cable support system extending between the ground and said tower, said cable support system anchored to the ground and connected to said tower, said cable support system including:

a plurality of cable sets connected to said tower, at least one of said plurality of cable sets associated with a corresponding one of each of said sides, each of said at least one cable sets having a first cable connected to one of said paired corner columns, a second cable connected to the other of said paired corner columns, and a third cable connected to said at least one intermediate column.

2. The structure of claim 1, wherein said at least one intermediate column includes two intermediate columns between paired ones of said corner columns; and each of said at least one cable sets includes a fourth cable connected to the other of said at least one intermediate column.

3. The structure of claim 1, wherein each of said at least one cable sets associated with said at least one side includes three cable sets comprising a cable group connected to a portion of said tower, said three cable sets including a lower cable set, an upper cable set, and an intermediate cable set between said upper cable set and said lower cable set.

4. The structure of claim 3, further comprising a number of anchors secured to the ground, each of said anchors associated with one of each of said number of sides, each of said anchors coupled to a corresponding one of said cable groups.

5. The structure of claim 1, wherein each of said at least one cable sets associated with said at least one side includes nine cable sets, a lower third of said nine cable sets comprising a lower cable group connected to a lower portion of said tower, an intermediate third of said cable sets comprising an intermediate cable group connected to an intermediate portion of said tower, and an upper third of said nine cable sets comprising an upper cable group connected to an upper portion of said tower.

6. The structure of claim 5, further wherein each of said cable groups is coupled to an anchor secured to the ground.

7. The structure of claim 6, wherein each of said anchors includes a first turnbuckle for connecting each of said first cables from said cable sets of said cable group coupled to said anchor; a second turnbuckle for connecting each of said second cables from said cable sets of said cable group coupled to said anchor; and a third turnbuckle for connecting each of said third cables from said cable sets of said cable group coupled to said anchor.

8. The structure of claim 5, wherein said at least one intermediate column includes two intermediate columns between paired ones of said corner columns; and each of said cable sets includes a fourth cable connected to the other of said at least one intermediate column.

9. The structure of claim 8, further wherein each of said cable groups is coupled to an anchor secured to the ground.

10. The structure of claim 9, wherein each of said anchors includes a first turnbuckle for connecting each of said first cables from said cable sets of said cable group coupled to said anchor; a second turnbuckle for connecting each of said second cables from said cable sets of said cable group coupled to said anchor; a third turnbuckle for connecting each of said third cables from said cable sets of said cable group coupled to said anchor; and a fourth turnbuckle for connecting each of said fourth cables from said cable sets of said cable group coupled to said anchor.

11. The structure of claim 1, wherein said number of sides and said number of corner columns is three.

12. The structure of claim 11, wherein said at least one intermediate column on each of said sides includes a first intermediate column and a second intermediate column positioned between paired ones of said corner columns.

13. The structure of claim 12, wherein said tower is comprised of a number of connected tower sections positioned one on top of another.

14. A structure for supporting an object above the ground, comprising:

a foundation;

a tower extending above the ground supported by said foundation, said tower having a first corner column, a second corner column, and a third corner column and a first side extending between said third corner column and said first corner column, a second side extending between said first corner column and said second corner column, and a third side extending between said second corner column and said third corner column, each of said three sides including a first intermediate column and a second intermediate column between said corner columns, said tower further comprising:

a main bracing system on each of said sides extending between said first and second intermediate columns;

a first sub-bracing system on each of said sides extending between said first intermediate column and an adjacent one of said corner columns;

a second sub-bracing system on each of said sides extending between said second intermediate column and the other of said corner columns; and a cable support system connected to said tower and anchored to the ground.

15. The structure of claim 14, further including a first internal sub-bracing system extending between said second intermediate column of said first side and said first intermediate column of said second side; a second internal sub-bracing system extending between said second intermediate column of said second side and said first intermediate column of said third side; and a third internal sub-bracing system extending between said second intermediate column of said third side and said first intermediate column of said first side.

16. The structure of claim 15, wherein each of said sub-bracing systems includes a plurality of cross members extending horizontally between said corner column and said intermediate column and diagonal members forming an X-shape extending between paired ones of said horizontal members.

17. The structure of claim 14, wherein said tower is comprised of a number of adjacent tower sections positioned one on top of another.

18. The structure of claim 17, wherein said main bracing system is continuous between adjacent ones of said tower sections.

19. The structure of claim 17, wherein each of said corner columns and each of said intermediate columns of said tower sections includes an upper base plate at an upper end and a lower base plate at a lower end, said lower base plates are supported on and coupled to the upper base plates of a lower tower section and said upper base plates support and are coupled to the lower base plates of an upper tower section.

20. The structure of claim 19, wherein said lower base plates of a bottom-most tower section are supported on and coupled to said foundation.

21. The structure of claim 14, wherein each of said sub-bracing systems includes:

a plurality of cross members extending horizontally between said corner column and said intermediate column; and diagonal members forming an X-shape extending between paired ones of said cross members.

22. The structure of claim 14, wherein said main bracing system includes a number of horizontal members extending between said first and second intermediate columns and lateral bracing extending between adjacent ones of said horizontal members.

23. The structure of claim 22, wherein said lateral bracing includes a first diagonal member and a second diagonal member forming an X-shape.

24. The structure of claim 14, wherein said cable support system includes:

a plurality of cable sets connected to said tower, at least one of said plurality of cable sets associated with a corresponding one of each of said sides, each of said at least one cable sets having a first cable connected to one of said paired corner columns, a second cable connected to the other of said paired corner columns, a third cable connected to said first intermediate column, and a fourth cable connected to said second intermediate column.

25. The structure of claim 24, wherein each of said at least one cable sets associated with said at least one side includes nine cable sets, a lower third of said nine cable sets comprising a lower cable group connected to a lower portion of said tower, an intermediate third of said nine cable sets comprising an intermediate cable group connected to an intermediate portion of said tower, and an upper third of said nine cable sets comprising an upper cable group connected to an upper portion of said tower.

26. A structure for supporting an object above the ground, comprising:

a foundation;

a tower extending above the ground supported by said foundation, said tower including a number of tower sections, each of sections of said tower having a first corner column, a second corner column, and a third corner column and a first side extending between said third corner column and said first corner column, a second side extending between said first corner column and said second corner column, and a third side extending between said second corner column and said third corner column, each of said sections further including:

a first truss having a triangular cross-section defined by said first corner column, a first intermediate column on said second side and a second intermediate column on said first side, said first truss further including:

a first sub-bracing system extending between said first intermediate column and said first corner column and a second sub-bracing system extending between said intermediate column and said first corner column;

a second truss having a triangular cross-section defined by said second corner column, a first intermediate column on said third side and a second intermediate column on said second side, said second truss further including:

a first sub-bracing system extending between said first intermediate column and said second corner column, and a second sub-bracing system extending between said second intermediate column and said second corner column;

a third truss having a triangular cross-section defined by said third corner column, a first intermediate column on said first side and a second intermediate column on said third side, said third truss further including:

a first sub-bracing system extending between said first intermediate column and said third corner column, and a second sub-bracing system extending between said second intermediate column and said third corner column; and a cable support system anchored to the ground and connected to the tower.

27. The structure of claim 26, further comprising:

a first main bracing system extending between and coupled to said first truss and said second truss;

a second main bracing system extending between and coupled to said second truss and said third truss; and a third main bracing system extending between and coupled to said first truss and said third truss.

28. The structure of claim 27, wherein each of said main bracing systems includes:

a number of horizontal members vertically positioned along said tower section; and lateral bracing extending between adjacent ones of said horizontal members.

29. The structure of claim 28, wherein said lateral bracing includes a first diagonal member and a second diagonal member forming an X-shape.

30. The structure of claim 28, wherein said number of horizontal members is three.

31. The structure of claim 27, wherein each of said main bracing systems is continuous between adjacent ones of said tower sections.

32. The structure of claim 26, further wherein:

said first truss includes a third sub-bracing system extending between said first intermediate column of said second side and said second intermediate column of said first side;

said second truss includes a third sub-bracing system extending between said first intermediate column of said third side and said second intermediate column of said second side; and said third truss includes a third sub-bracing system extending between said first intermediate column of said first side and said second intermediate column of said third side.

33. The structure of claim 32, wherein each of said sub-bracing systems includes:

a plurality of cross members extending horizontally between said corresponding columns; and diagonal members forming an X-shape extending between paired ones of said cross members.

34. The structure of claim 33, wherein said plurality of cross members is six.

35. The structure of claim 26, further comprising an internal tie system at the top of each tower section extending between said intermediate columns.

* * * * *